US009562664B2

(12) United States Patent
Silvi

(10) Patent No.: US 9,562,664 B2
(45) Date of Patent: Feb. 7, 2017

(54) VEHICLE HEADLAMP REGULATED AIRFLOW SYSTEM AND METHOD

(71) Applicant: Robert Silvi, Southfield, MI (US)

(72) Inventor: Robert Silvi, Southfield, MI (US)

(73) Assignee: OSRAM SYLVANIA Inc., Wilmington, MA (US)

( * ) Notice: Subject to any disclaimer, the term of this patent is extended or adjusted under 35 U.S.C. 154(b) by 0 days.

(21) Appl. No.: 14/599,800

(22) Filed: Jan. 19, 2015

(65) Prior Publication Data

US 2016/0208997 A1 Jul. 21, 2016

(51) Int. Cl.
*F21S 8/10* (2006.01)
*F02D 9/08* (2006.01)

(52) U.S. Cl.
CPC ..... *F21S 48/325* (2013.01); *F02D 9/08* (2013.01)

(58) Field of Classification Search
CPC .... F21S 48/325; B60Q 1/0035; B60Q 1/0408; F02D 9/08
See application file for complete search history.

(56) References Cited

U.S. PATENT DOCUMENTS 5,406,467 A 4/1995 Hashemi
6,021,954 A 2/2000 Kalwa et al.
6,071,000 A 6/2000 Rapp
6,447,151 B1 9/2002 Jones
6,497,507 B1 12/2002 Weber
6,595,672 B2 7/2003 Yamaguchi
6,676,283 B2 1/2004 Ozawa et al.
7,329,033 B2 2/2008 Glovatsky et al.
7,478,932 B2 1/2009 Chinniah et al.
2002/0181247 A1* 12/2002 Yamaguchi ..... B60Q 1/0088 362/547
2007/0091632 A1* 4/2007 Glovatsky ..... B60Q 1/0052 362/547
2007/0121336 A1* 5/2007 Chinniah ..... F21S 48/325 362/507
2007/0127257 A1* 6/2007 Erion ..... F21S 48/1159 362/547
2008/0225537 A1* 9/2008 Tronquet ..... F21S 48/325 362/487
2009/0196063 A1* 8/2009 Kracker ..... B60Q 1/0017 362/547
2011/0310631 A1 12/2011 Davis
2012/0127744 A1* 5/2012 Lin ..... F21S 48/325 362/487

* cited by examiner

*Primary Examiner* — Julie Bannan
(74) *Attorney, Agent, or Firm* — Edward S. Podszus

(57) ABSTRACT

A headlamp duct 28 is connected with engine ducting 2 between air inlet 40 and ducting outlet 42 which is coupled to the engine. Headlamp duct 28 receives airflow 13 from engine ducting 2 and directs airflow to vehicle headlamp 30. A valve 6 disposed between headlamp duct 28 and engine ducting 2 is displaceable between a first position and a second position, whereby in the first position valve 6 permits airflow to headlamp duct 28 to be discharged toward vehicle headlamp 30, and in the second position valve 6 occludes airflow more to headlamp duct 28. Valve 6 is preferably responsive to air pressure in engine ducting 2. At low engine throttle, valve 6 permits airflow to headlamp duct 28 and at high engine throttle valve 6 is displaced to the second position, increasing air flow to the engine.

18 Claims, 2 Drawing Sheets

VEHICLE HEADLAMP REGULATED AIRFLOW SYSTEM AND METHOD

CROSS REFERENCE TO RELATED APPLICATIONS

N/A

TECHNICAL FIELD

The present disclosure relates generally to a regulatable air duct to provide air to a vehicle headlamp, in particular engine throttle-responsive headlamp cooling.

BACKGROUND

In general, in an automotive headlamp using LEDs (light-emitting diodes), it is beneficial to manage the heat dissipated by the drive circuitry and by the LEDs themselves. Heat management approaches using large heat sinks or actively driven cooling fans are known, but these such components add weight, cost, restrict design space, and in the case of an actively driven fan can decrease overall robustness of the system. Software approaches to heat management are known such as programming the drive circuits to decrease power to lower the heat generated when temperature exceeding a pre-determined threshold is sensed, but this is also expensive.

The following vehicle lamps are known: U.S. Pat. No. 7,329,033 (Glovatsky); U.S. Pat. No. 6,497,507 (Weber); U.S. Pat. No. 6,447,151 (Jones); U.S. Pat. No. 7,478,932 (Chinniah); U.S. Pat. No. 6,676,283 (Ozawa); U.S. Pat. No. 6,595,672 (Yamaguchi); U.S. Pat. No. 6,071,000 (Rapp); U.S. Pat. No. 6,021,954 (Kalwa); U.S. Pat. No. 5,406,467 (Hashemi); and Application US 2011/0310631 (Davis). In U.S. Pat. No. 7,329,033 (Glovatsky) it is known to provide cooling air to ducts arranged in a headlamp assembly using a forced convective flow shown in FIG. 2A therein which occurs as the vehicle is moving forward; or a natural convective flow shown in FIG. 2B therein; or by use of an additional fan as forced air flow shown in FIGS. 2C-D therein. U.S. Pat. No. 6,021,954 (Kalwa) discloses a headlamp housing whose interior space is aerated by regulating a valve responsive to humidity.

SUMMARY OF THE EMBODIMENTS

A headlamp venting system is provided for a vehicle having a vehicle headlamp 30 configured to receive a light source 33, in which the venting system includes a vehicle air intake comprising an engine ducting 2 adapted to receive airflow from an air inlet 40 and conduct airflow in a flow direction 13 to a ducting outlet 42 which is coupled to the vehicle engine. A headlamp duct 28 is connected in fluid communication with the engine ducting 2 between the air inlet 40 and the ducting outlet 42. The headlamp duct 28 is adapted to receive airflow 13 from the engine ducting 2 and direct airflow to the vehicle headlamp 30. A valve 6 is disposed between the headlamp duct 28 and the engine ducting 2 and is displaceable between a first position and a second position, whereby in the first position valve 6 permits airflow to the headlamp duct 28 to be discharged toward the vehicle headlamp 30, and in the second position valve 6 occludes airflow to the headlamp duct 28 to a greater extent than in the first position. Thus, at low engine throttle valve 6 permits airflow to the headlamp duct 28 and at high engine throttle valve 6 is displaced to the second position.

BRIEF DESCRIPTION OF THE DRAWINGS

Reference should be made to the following detailed description, read in conjunction with the following figures, wherein like numerals represent like parts.

Figure 1:
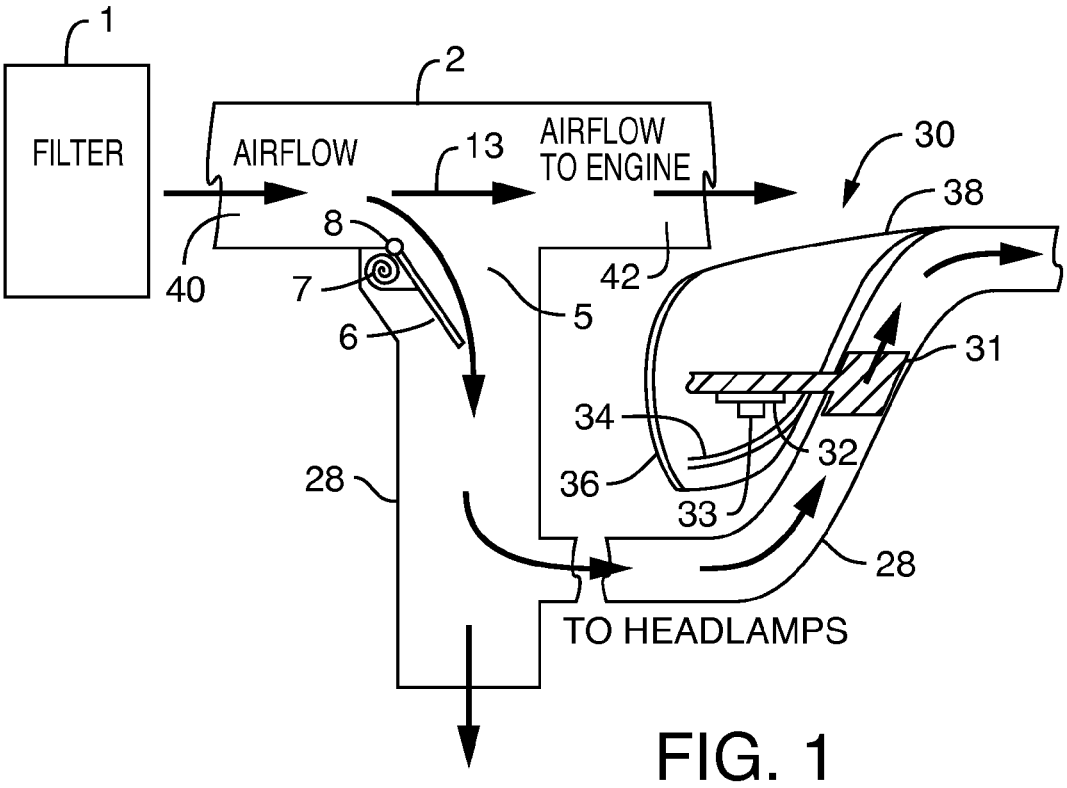
FIG. 1 illustrates a schematic of the air duct system with the valve to the headlamp duct open.

For a thorough understanding of the present disclosure, reference should be made to the following detailed description, including the appended claims, in connection with the above-described drawings. Although the present disclosure is described in connection with exemplary embodiments, the disclosure is not limited to the specific forms set forth herein. It is understood that various omissions and substitutions of equivalents are contemplated as circumstances may suggest or render expedient. Also, it should be understood that the phraseology and terminology used herein is for the purpose of description and should not be regarded as limiting.

DETAILED DESCRIPTION INCLUDING BEST MODE OF A PREFERRED EMBODIMENT

Applicant herein proposes an air flow system and method to use an airflow, advantageously using a passively regulated air flow, that avoids the need for a forced-air device such as a fan, and diverts some air from the engine air intake ducting. Another advantage of use of the proposed embodiment is that it can allow for a reduction in size and weight of a heat sink associated with an LED headlamp, and thus a reduction in cost.

The air flow solution proposed herein is useful not only in motor vehicles designed to travel on roads, but can advantageously be used in other vehicle applications such as trains, boats, tractors, off-road vehicles, snowmobiles, and the like.

Automotive design is often predicated on a consideration of a worst case scenario. In the case of excessive heat affecting an LED headlamp performance, this would assume such factors as a hot climate with maximum sunlight exposure, the headlamp's being on, the vehicle motor running and no external airflow, such as with a stationary, idling vehicle. It can be the case that once the vehicle is in motion, that additional airflow would help mitigate heat buildup. The present inventor herein recognized and expects that even a small amount of airflow, such as that corresponding to a vehicle speed exceeding 5 mph (or about 8 kmh) can help improve the thermal performance of an LED lighting system, for example by using air scoops under the chassis proximate the headlamps, thus solving a stagnant air problem, even when no special ducting system as hereinbelow described is used to direct air to the headlamp.

As background, it is conventionally known that, in general, an engine throttle is typically a butterfly valve, placed at the entrance of the intake manifold. The butterfly valve is also referred to as a throttle plate, which is a moving piece inside a throttle body. On many vehicles, the accelerator pedal motion is communicated via a throttle cable to activate the throttle linkages which move the throttle plate. In cars with electronic throttle control, an electric motor controls the throttle linkages and the accelerator pedal connects not to the throttle body but to a sensor, and this sensor sends the pedal position to an Engine Control Unit (ECU). The ECU determines the throttle opening based on accelerator pedal position and inputs from other engine sensors. When the driver presses on the accelerator pedal, the throttle plate rotates within the throttle body, opening the throttle passage to allow more air into the intake manifold, which is herein referred to, relatively, as a "high throttle" condition. Usually an airflow sensor measures this change and communicates with the ECU.

Figure 2:
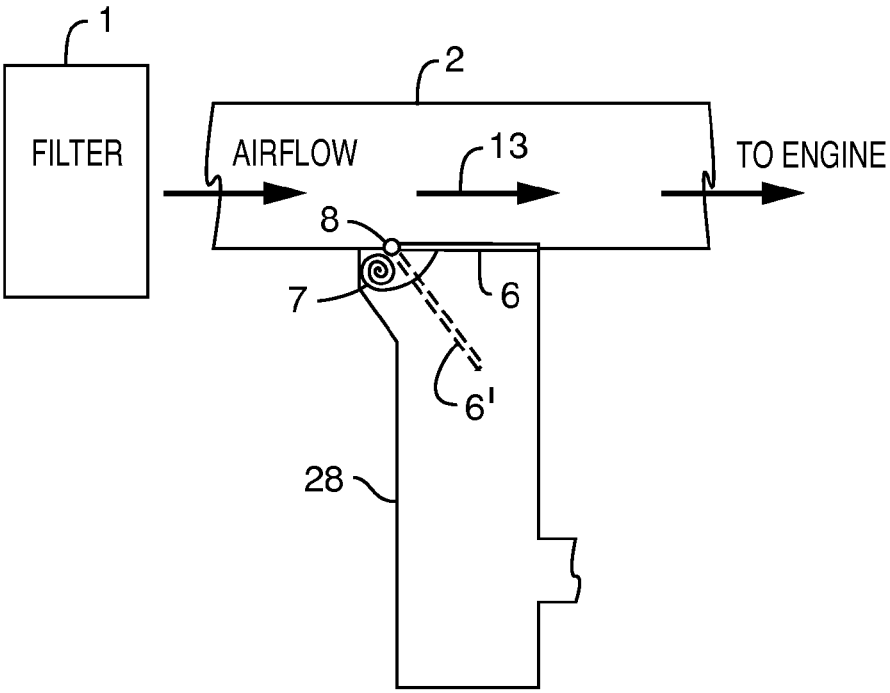
FIG. 2 illustrates an schematic of the air duct system with the valve to the headlamp duct closed.
Figure 3:
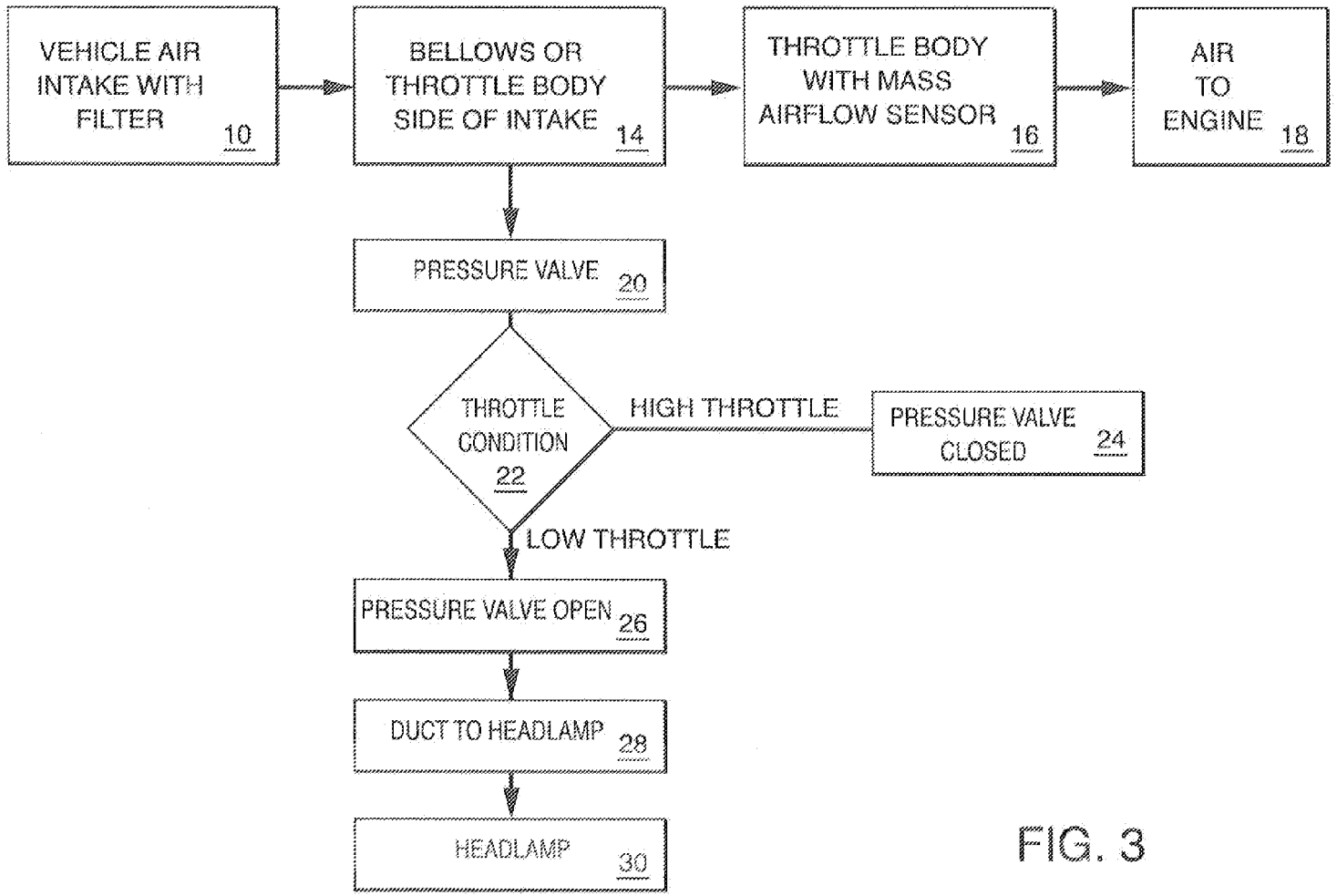
FIG. 3 illustrates a process flow diagram.

With reference to FIGS. 1-3, FIG. 3 depicts a flowchart of operation in which a method for cooling the headlamp is generally illustrated. A vehicle is equipped with a vehicle air intake preferably with a filter 1 (operation 10). Valve 6 is located in a portion of the engine ducting located on a bellows or throttle body side of the air intake in the engine ducting (operation 14). Valve 6 is advantageously located after air filter 1 to prevent particle or grime buildup at or in the headlamp assembly and to help ensure predictable air pressure (operation 20). Valve 6 is responsive to a throttle condition (decisional operation 22). The disclosed embodiment of a regulated airflow system takes a small amount of airflow typically used for engine combustion and routes it to the headlamp (or headlamps) during low throttle condition, such as that corresponding to the vehicle stationary or moving at very slow speed, in which condition the pressure valve 6 is open (operation 26). In the valve 6 open condition (see FIG. 1), a portion of the airflow that was taken in at the vehicle intake is routed to headlamp 30. This routing to headlamp 30 is advantageously guided by one or more air guiding surfaces, such as a headlamp duct 28, which may be formed from one or more surfaces defining, in cross-section, an open-wall or a closed-wall configuration. However, at higher vehicle speed operation, which is also referred to as a higher throttle condition, once the throttle is pressed the air pressure is lower above valve 6, so the lower air pressure pulls valve 6 towards a more closed, or a fully closed, position (operation 24), as depicted schematically in FIG. 2, in which 6' designates the previously open valve 6, and thus more intake air, or advantageously all the intake air when valve 6 is fully closed, is routed to the engine for best combustion and performance (operations 18 and 24). Such a valve that is actuated by the change in air pressure above the valve is referred to herein as a pressure valve; furthermore, the operation of the system in which it is incorporated can be referred to as a passive regulation of the headlamp air intake routing, since valve position is mechanically responsive to the throttle condition. This closing of valve 6 also restricts unfiltered air from being pulled into the engine via headlamp duct 28 connecting the valve assembly to headlamp 30.

Preferably valve 6 is advantageously located before the mass airflow sensor so that the vehicle computer can adjust for the changing amount of intake air (operation 16).

The light source is preferably a solid-state light source such as light emitting diode 33 ("LED") attached to a printed circuit board (PCB) 32 that includes electronics controls and connections for driving and controlling the LED 33. In a known manner light emitted from LED 33 strikes optics such as reflector 34 which re-directs the light rays in the forward direction through a lens or lens cover 36. The LED 33 and PCB 32 are supported on heat sink 31 accommodated within housing 38. Heat sink 31 advantageously has heat exchange fins that extend into headlamp duct 28 for discharging heat generated by operation of LED 33. Heat sink 31 is constructed of material having a relatively high thermal conductivity. During operation of headlamp assembly 30, LED 33 generates heat and LED 33 and/or other electronic components may experience diminished performance if its or their respective maximum operating temperature is exceeded. To reduce the temperature of these components, heat sink 31 discharges heat into an airflow guided by headlamp duct 28.

Headlamp duct 28 is not required to be a channel completely bounded, as seen in cross-section, on all sides, such as a tube or closed rectangular cross-sectional shape. Headlamp duct 28 is sufficiently defined by one or more surfaces that guide airflow proximate the headlamp assembly 30 to interact with heat sink 31.

FIG. 1 depicts schematically an operating arrangement in low throttle condition. As shown in FIG. 1, air introduced through filter 1 is conducted further through engine ducting 2 having air inlet 40 as airflow 13 towards a ducting outlet 42 coupled to the engine (not shown). At a duct junction 5 location along engine ducting 2, preferably as shown in FIG. 3 prior to a throttle body assembly (operation block 14) and airflow sensor associated with the throttle body (operation block 16), a headlamp duct 28 branches off engine ducting 2. Valve 6 is positioned between headlamp duct 28 and engine ducting 2. A biasing member 7, such as a spring, biases valve 6 to move, such as to pivot about pivot 8, to an open position, as shown in FIG. 1, promoting a portion of airflow 13 to enter headlamp duct 28. As described above, air entering headlamp duct 28 is conducted further, as shown in partial cutaway, towards heat sink 31.

FIG. 2 depicts schematically an operating arrangement in high throttle condition, in which it is noted that valve 6 has been drawn to a more closed position to occlude air flow into headlamp duct 28. Preferably valve 6 is moved to a position to substantially close off or even more preferably to fully close off air flow to headlamp duct 28, which then routes more intake air to the engine. In FIG. 2 the previously open position of valve 6' is indicated by phantom line. In a desired embodiment in which bias member or spring 7 biases valve 6 open, the reduced air pressure in the engine high throttle condition overcomes the spring bias and draws valve 6 away from an open position towards a closed or a fully closed position.

In alternate embodiments not illustrated, valve 6, rather than being the depicted valve that passively and mechanically responds directly to change in air pressure in the air intake duct, may be electronically controlled by an electronic sensor that is responsive to engine throttle speed or to air pressure, such as a sensor positioned in engine ducting 2.

The disclosed embodiment can be built as part of an Original Equipment Manufacturer (OEM) system or designed as a retrofit kit for vehicles in a similar manner to a cold air intake system, such as by splicing into the existing engine air ducting 2. In such a retrofit kit a headlamp duct 28 bearing a valve 6 would be provided; then a splice would be made by cutting into engine ducting 2 and attaching a proximal first portion of headlamp duct 28 at a suitable duct junction 5; and then one would position a distal second portion of headlamp duct 28 adjacent a heat-emitting portion of headlamp 30 such as adjacent heat sink 31.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used.

Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, are understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

An abstract is submitted herewith. It is pointed out that this abstract is being provided to comply with the rule requiring an abstract that will allow examiners and other searchers to quickly ascertain the general subject matter of the technical disclosure. It is submitted with the understanding that it will not be used to interpret or limit the scope or meaning of the claims, as set forth in the rules of the U.S. Patent and Trademark Office.

An exemplary, non-limiting list of reference numerals used herein follows:

1 air filter
2 engine ducting
5 duct junction
6 valve
6' valve (phantom line)
7 biasing spring
8 pivot
10, 14, 16, 18, 20, 22, 24, 26 operations
13 airflow
28 headlamp duct
30 headlamp
31 heat sink
32 PCB
33 LED
34 reflector
36 lens cover
38 housing
40 air intake
42 engine air duct outlet

What is claimed is:

1. A headlamp venting system for a vehicle having a vehicle headlamp (30) configured to receive a light source (33), comprising:

a vehicle air intake comprising an engine ducting (2) adapted to receive airflow from an air inlet (40) and conduct airflow in a flow direction (13) to a ducting outlet (42), the ducting outlet conducting airflow to a vehicle engine;

a headlamp duct (28) connected in fluid communication with the engine ducting (2) between the air inlet (40) and the ducting outlet (42), the headlamp duct (28) adapted to receive airflow (13) from the engine ducting (2) and direct airflow to the vehicle headlamp (30); and a valve (6) disposed between the headlamp duct (28) and the engine ducting (2), said valve (6) displaceable between a first position and a second position, whereby in the first position the valve (6) permits airflow to the headlamp duct (28) to be discharged toward the vehicle headlamp (30), and whereby in the second position the valve (6) occludes airflow to the headlamp duct (28) to a greater extent than in the first position;

whereby at a low engine throttle the valve (6) permits airflow to the headlamp duct (28) and at a high engine throttle the valve (6) is displaced to the second position.

2. The headlamp venting system of claim 1, wherein the valve (6) is biased to the first position.

3. The headlamp venting system of claim 1, further comprising a spring (7) biasing the valve (6).

4. The headlamp venting system of claim 2, further comprising a spring (7) biasing the valve (6).

5. The headlamp venting system of claim 1, wherein the valve is a pressure valve.

6. The headlamp venting system of claim 1, wherein in the second position the valve (6) is closed, whereby airflow to the headlamp duct (28) is substantially prevented.

7. The headlamp venting system of claim 1, further comprising an air intake filter (1) positioned, in the airflow direction, upstream of the air inlet (40) of the engine ducting (2).

8. The headlamp venting system of claim 1, further in combination with the vehicle headlamp (30) configured to receive the light source (33).

9. A method of regulating a flow of air to a vehicle headlamp (30) that is configured to receive a light source (33) in a vehicle provided with an engine duct (2) configured to receive air from an air inlet (40) and conduct the air to a vehicle engine, comprising:

connecting, to the engine duct (2), a headlamp duct (28) configured to provide a fluidic flow path between the engine duct (2) and the vehicle headlamp (30);

flowing air through the engine duct (2) from the air inlet to the vehicle engine;

selectively diverting a portion of air flowing through the engine duct (2) to the headlamp duct (28); and discharging the diverted portion of air to the vehicle headlamp, whereby the discharged portion of air cools the vehicle headlamp.

10. The method of claim 9, wherein the selectively diverting the portion of air is responsive to throttling the engine.

11. The method of claim 9, wherein the selectively diverting the portion of air further comprises diverting a greater portion of air entering the air inlet to the headlamp duct while throttling the engine a low amount than is diverted while throttling the engine a high amount.

12. The method of claim 11, comprising substantially preventing flow of air to the headlamp duct during throttling the engine the high amount.

13. The method of claim 9, wherein the selectively diverting the portion of air is responsive to an air pressure within the engine duct.

14. The method of claim 9, wherein the selectively diverting the portion of air further comprises diverting a greater portion of air entering the air inlet to the headlamp duct in response to a first pressure in the engine duct than is diverted while in response to a second pressure in the engine duct lower than the first pressure.

15. The method of claim 14, comprising substantially preventing flow of air to the headlamp duct in response to the second pressure.

16. The method of claim 9, further comprising providing a valve (6) between the engine duct (2) and the headlamp duct (28), the valve being responsive to air pressure within the engine duct;

displacing the valve in response to a first pressure in the engine duct to a first position permitting the diverting a portion of air to the headlamp duct; and displacing the valve in response to a second pressure lower than the first pressure in the engine duct to a second position reducing the diverting of air to the headlamp duct.

17. The method of claim 16, wherein displacing the valve in response to a second pressure prevents flow of air to the headlamp duct.

18. The method of claim 9, further comprising filtering the air prior to receiving air into the engine duct.

* * * * *